United States Patent [19]

Bräuning

[11] Patent Number: 4,798,358

[45] Date of Patent: Jan. 17, 1989

[54] VERTICALLY ADJUSTABLE SWIVEL CHAIR SUPPORTING COLUMN

[75] Inventor: Egon Bräuning, Weil am Rhein, Fed. Rep. of Germany

[73] Assignee: Protoned B.V., Netherlands

[21] Appl. No.: 73,366

[22] Filed: Jul. 6, 1987

Related U.S. Application Data

[63] Continuation of Ser. No. 734,772, May 16, 1985, abandoned.

[30] Foreign Application Priority Data

May 30, 1984 [CH] Switzerland ..... 2677/84

[51] Int. Cl.[4] ..... F16M 13/00

[52] U.S. Cl. ..... 248/161; 248/415

[58] Field of Search ..... 248/161, 162.1, 404–414, 248/188.2, 631, 562, 565, 157, 415–418; 267/64.11, 64.12; 297/345, 347, 349

[56] References Cited

U.S. PATENT DOCUMENTS

| | | | |
|---|---|---|---|
| 437,188 | 9/1890 | Franklin | 248/415 X |
| 2,016,132 | 10/1935 | Bergslien | 248/409 |
| 2,171,653 | 9/1939 | Heitmann | 248/409 |
| 3,064,934 | 11/1962 | Desmarais | 248/409 |
| 3,825,244 | 7/1974 | Bauer | 267/64.12 X |
| 3,828,694 | 8/1974 | Nestler | 248/157 |
| 4,245,826 | 1/1981 | Wirges | 297/345 X |
| 4,394,001 | 7/1983 | Wisniewski | 297/345 X |
| 4,513,845 | 4/1985 | Stephens et al. | 267/64.12 X |

FOREIGN PATENT DOCUMENTS

| | | | |
|---|---|---|---|
| 7701544 | 8/1978 | Netherlands | 248/409 |
| 451122 | 7/1936 | United Kingdom | 248/408 |
| 1046732 | 10/1966 | United Kingdom | 248/161 |
| 1226763 | 3/1971 | United Kingdom | 248/409 |

*Primary Examiner*—Alvin C. Chin-Shue

*Attorney, Agent, or Firm*—Lahive & Cockfield

[57] ABSTRACT

The vertically adjustable swivel-chair supporting column with an upright tube (1) located on the foot and with a support tube (2) telescopically movable in the latter and intended for receiving the chair seat part is provided with a lockable length-adjusting element (21) which is installed between the two tubes (1, 2) and the pull-out length of which can be adjusted in steps. The length-adjusting element (21) connected to a tube (1, 2) fixed on the same side as the foot and extendable on the same side as the seat carries, at the distal end (2.1) of the support tube (2), a guide member (22), in which is retained a linkage member (41, 42) intended for controlling the pull-out length of the supporting column. The length-adjusting element (21) is centered and supported by means of a spring intermediate piece (23) on the fixed end (1.1) of the upright tube (1).

3 Claims, 2 Drawing Sheets

Figure 1:
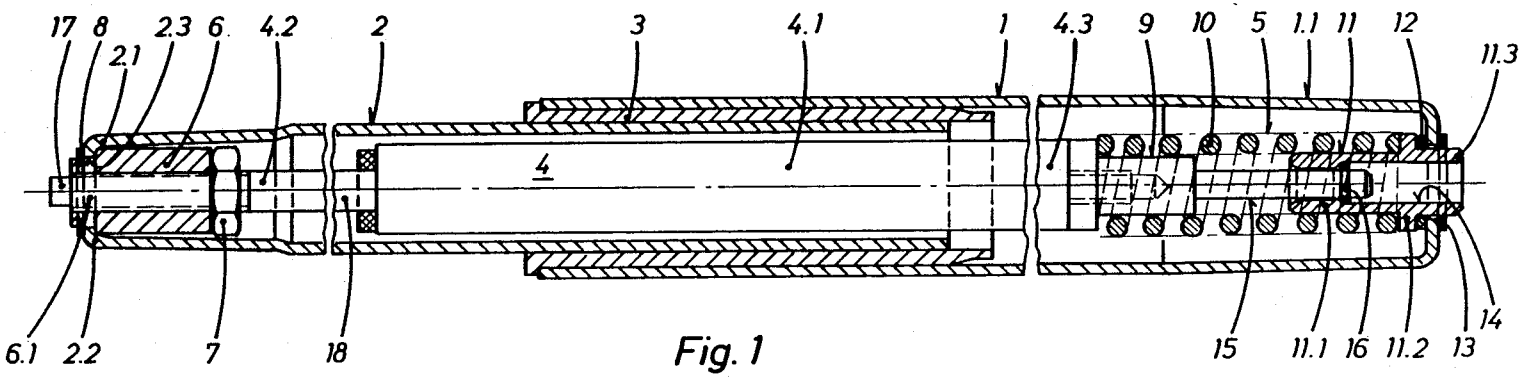

VI
VII
V

VERTICALLY ADJUSTABLE SWIVEL CHAIR SUPPORTING COLUMN

This application is a continuation of application Ser. No. 734,772, filed May 16, 1985, now abandoned.

The invention relates to a vertically adjustable swivel-chair supporting column.

Vertically adjustable supporting columns are advantageously used for work chairs and seats with a seat shell supported centrally on the base, wherein the desired height of the supporting column can be set quickly and accurately, but, nevertheless cannot be varied inadvertently. Known supporting columns of this type are preferably provided with telescopic upright and support tubes which, at least in the region of the desired height, allow slight spring compression to guarantee reasonable sitting comfort and comfort during use. Such constructions are usually made so compact that the individual sections have to be matched to individual requirements to achieve the best possible design criteria. At the same time, it is almost impossible to equip upright and support tubes of the same dimensions selectively with different adjusting elements or adjusting devices.

The object of the invention which is to be achieved is therefore to provide a vertically adjustable swivel-chair supporting column of the type mentioned in the introduction, in which different adjusting elements can be fitted selectively by means of connecting members which remain identical or similar to one another. In particular, a chair column with a mechanical locking device, which consists of components simple to produce and which can be assembled reliably for a low outlay in terms of construction, will be provided.

The main and subsidiary objects are achieved by means of a chair supporting column which is defined according to the features of patent claim 1. Embodiments of this are defined by the dependent claims.

Exemplary embodiments and details of the invention are described below with reference to the drawing.

Figure 2:
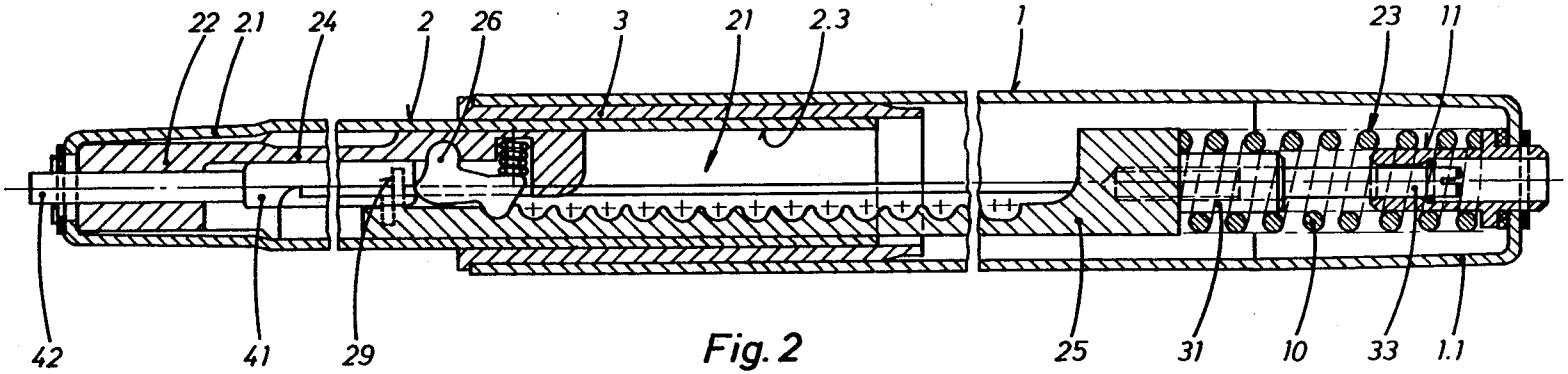
Figures 3, 4A, 4B, 5, 6, 7:
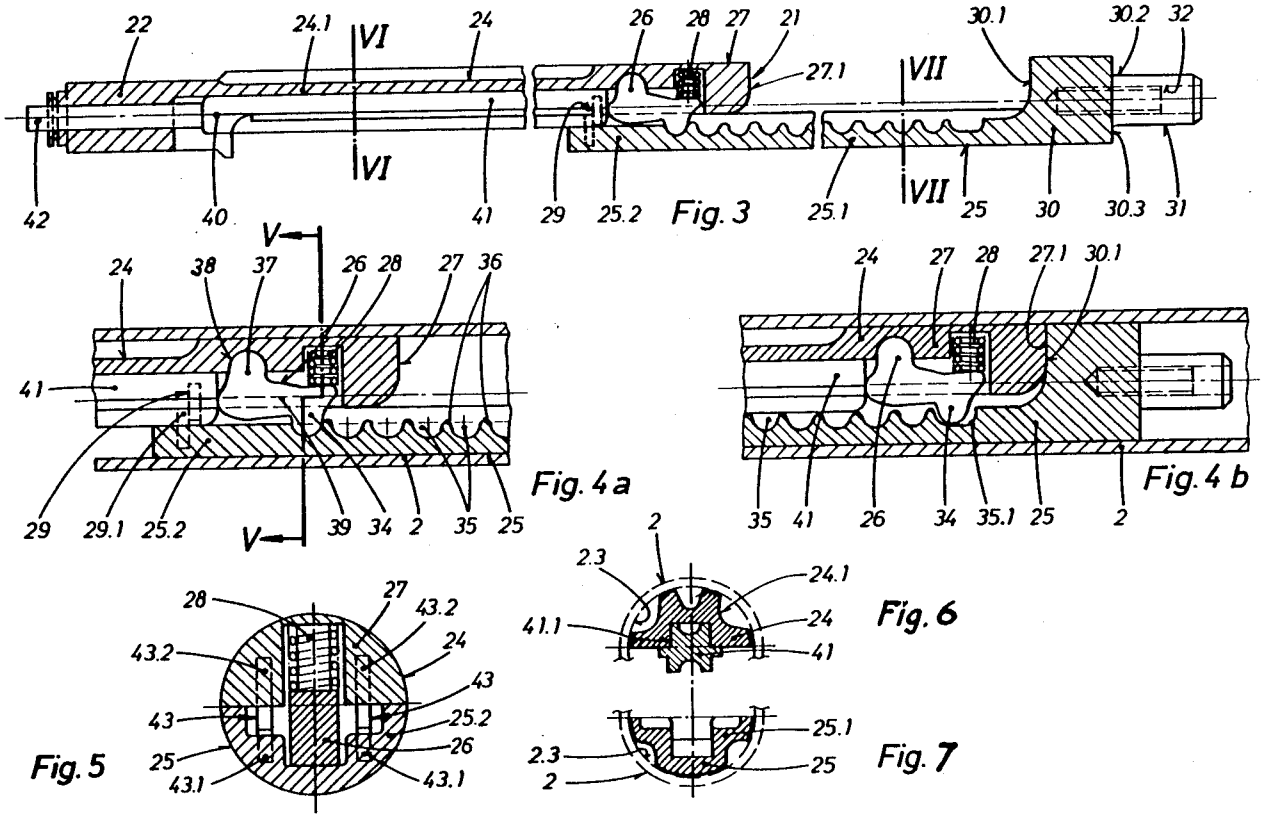

In the drawing:

FIG. 1 shows a representation in the form of a longitudinal section illustrating the principle of the swivel-chair supporting column according to the invention, FIG. 2 shows a second embodiment of the supporting column longitudinal section, FIG. 3 shows the length-adjusting arrangement of the supporting column according to FIG. 2, FIGS. 4*a* and 4*b* show the locking mechanism according to FIG. 3 on a larger scale, with the chair column in a fully extended position (a) and in a fully retracted position (b), FIG. 5 shows a section along the line V—V in FIG. 4*a*, and FIGS. 6 and 7 show sections in the planes VI—VI and VII—VII in FIG. 3.

The chair supporting column illustrated in FIG. 1 consists essentially of an outer upright tube 1, the distal end 1.1 of which is connectable to the foot part (not shown) of a swivel chair; of a support tube 2 which is telescopically movable in the upright tube 1 and on the distal end 2.1 of which the chair seat part (also not shown) can be attached; a shift-centering lining sleeve 3 arranged between these two tubes and closing them in an essentially dust-proof manner; and a lockable length-adjusting element 4 shown diagrammatically, the pull-out length of which can be adjusted continuously or in steps. The length-adjusting element 4 has a first stationary portion 4.1 connected to the upright tube 1 via a sprung intermediate member 5, and a second longitudinally movable portion 4.2 preferably connected firmly to the support tube 2. This portion 4.2 contains at its distal end a first guide member 6, 6.1 of stepped diameter, which centers the portion 4.2 in the slightly conical outer end portion 2.1 and which supports it against its flanged-in edge shoulder 2.2.

The stepped projection 6.1 of the guide member 6, which passes through an orifice limited by the edge shoulder 2.2, is provided with a fastening arrangement which retains the guide member 6 on the end portion 2.1. In FIG. 1, the longitudinally movable portion 4.2 can be, for example, the distal end of a pneumatic-spring piston rod, which is provided with a thread (not shown). The guide member 6 is screwed in the form of a sleeve on this thread and is locked by means of a nut 7. The stepped projection 6.1 can be provided with an encircling groove which receives a Seeger ring 8 attached to the outside of the edge shoulder 2.2 and which thus forms the said fastening arrangement. The longitudinally movable portion 4.2 or, in the case of a pneumatic spring, its piston rod has passing through it a control bar (not shown), the outer end 17 of which is designed as a control member and extends beyond the stepped projection 6.1, so as to be actuated by a control mechanism (not shown). It goes without saying that the guide member 6, its fastening elements 6.1 and 8 and the control member 17 can also be formed by other means.

In FIG. 1, the stationary portion 4.1 connected via the sprung intermediate member 5 to the upright tube 1 and centered in the latter can be, for example, the cylinder part of the said pneumatic spring, on the bottom end of which a second guide member 9 in the form of a screw journal 9 is attached. This screw journal 9 guides and supports one end of a helical compression spring 10 which, together with the journal 9, is an integral component of the sprung intermediate member 5. The latter also includes a guide bush 11 which is also referred to below as a spring bush because of its function. On the outside of an elongate inner portion 11.1, the spring bush 11 centers the other end of the compression spring 10 which is also supported against the inner face of an annular shoulder 11.2 on the portion 11.1. Adjoining the outer face of the annular shoulder 11.2 is a shorter bush end portion 11.3 which, together with the outer face of the annular shoulder 11.2, performs a double function: firstly, it serves as a supporting and pivot mounting for the spring bush 11 in a central bore (not designated) in the bottom end 1.1 of the upright tube 1 which terminates slightly conically on this side. An intermediate ring 12, preferably made of a self-lubricating plastic material, is also provided for the supporting mounting. Secondly, the end portion 11.3 contains an arrangement for fixing the spring bush 11 to the bottom end 1.1, this arrangement containing a Seeger ring 13 attached to the spring bush 11 on the outside of the bottom end 1.1. It goes without saying that this fixing can also be carried out by other means.

The spring bush 11 also contains a stepped central longitudinal bore 14, a centering pin 15 connected to the screw journal 9 (or in one piece with it) engaging rotatably in the part of the longitudinal bore 14 having the smaller diameter. The centering pin 15 possesses next to its distal end a pull-out prevention device 16 which when the sprung intermediate member 5 is installed, prevents the centering pin 15 from escaping from the bore 14. The pull-out prevention device 16 can be a groove/clamping-ring combination, as illustrated, and in this case the part of the clamping ring projecting beyond the pin diameter forms a passage block on the shoulder face of the stepped portion of the bore.

FIG. 2 illustrates a supporting column outwardly of a design similar or identical to that of the swivel-chair supporting column of FIG. 1. Components of identical design or performing identical functions are designated by the same reference numerals as in FIG. 1. Inside the outer upright tube 1 is located a support tube 2 arranged telescopically in it and separated from it by a lining sleeve 3 made of low-friction plastic or a self-lubricating sintered bearing metal. The adjusting element located inside the support tube 2 and designated as a whole by 21 is shown separately in FIG. 3 for the sake of greater clarity and, in a similar way to FIG. 1, is supported in the receiving end of the support tube 2 by a first guide member 22 and in the receiving end of the upright tube 1 by a sprung intermediate member 23. The latter can have basically the same design as the sprung intermediate member 5 according to FIG. 1. Its details will therefore be described only in as much as this is necessary to illustrate the mode of operation of the length-adjusting element 21 or insofar as there are differences from that shown in FIG. 1. Like the intermediate member 5, it can have a different design in detail from that shown.

The length-adjusting element 21 consists essentially of an elongate slide part 24 and an elongate toothed engagement part 25. The two parts 24 and 25 are mounted so as to be displaceable relative to one another inside the bore 2.3 of the support tube 2, the slide part 24 being fixed in the support tube 2, whereas the toothed engagement part 25 is mounted displaceably. The two parts 24, 25 are engaged with one another via a detent pawl 26, as emerges from the detail illustrated in FIGS. 4*a* and *b* and FIG. 5 (section V—V in FIG. 4*a*), the latter on a larger scale. The slide part 24 advantageously formed from a polymer plastic is profiled essentially according to FIG. 6 in its central length portion 24.1, to obtain an approximately constant peripheral wall thickness, the periphery generatrix being aligned with the bore 2.3 of the support tube 2. A transitional portion (not designated) to the guide member 22 adjoins this profiled length portion 24.1 on the left in FIG. 3. On the right (in the center of FIG. 3), the length portion 24.1 ends in a pawl housing designated as a whole by 27, in which the detent pawl 26 and a helical compression spring 28 are mounted. The detent-pawl mounting is described in detail later.

The toothed engagement part 25, is likewise appropriately formed from a polymer possesses in its central length portion 25.1 a rack-shaped longitudinal profiling and a transverse profiling according to FIG. 7. The cross-sectional peripheral form, like that of the slide part 24 or its portion 24.1, is aligned with the bore 2.3 of the support tube 2 and is also designed so that a peripheral wall of approximately equal thickness everywhere is obtained. A toothless end zone 25.2 (FIGS. 3 and 4*a*) adjoins the rack-shaped length portion 25.1 on the left (in the center in FIG. 3) and carries a member 29.1 of a stop arrangement 29, explained later, for limiting the pull-out travel between the slide part 24 and the toothed engagement part 25. On the right, the toothed engagement part 25 contains, at the end of the toothed length portion 25.1, a cylindrical head piece 30 which has on the same side as the teeth a stop surface 30.1 for the front end 27.1 of the pawl housing 27 on the slide part 24. The diameter of the head piece 30 is likewise matched to the bore diameter 2.3 of the support tube 2 and allows a sliding fit, as can be seen in FIG. 4*b*. The end face 30.2 of the head piece 30 is provided with a centering pin 31 as a spring guide for the sprung intermediate member 23 (FIG. 2) and also has a bearing shoulder 30.3 for the spring 10 of the intermediate member. A threaded bore 32 is intended for receiving a clamping bolt 33 which can be used instead of the centering pin 15 in the sprung intermediate member 5 described with reference to FIG. 1.

To explain the engagement between the slide part 24 and the toothed engagement part 25, attention is drawn not only to FIG. 3, but also to FIGS. 4*a* and 4*b* and to FIGS. 5 to 7. The toothing profile in the central length portion 25.1 is matched to the shape of the engagement cam 34 on the detent pawl 26, that is to say the approximately semi-cylindrical engagement cam 34 fits free of play into the correspondingly rounded tooth spaces 35. The tooth tips 35 are appropriately rounded to ensure a "smooth" transition from one tooth space to the other. The detent pawl 26 has an approximately Z-shaped design, one leg being formed by the already mentioned engagement cam 34, whilst the other leg is designed as a spherical or semi-cylindrical head 37 of a socket joint 38. In the engaged position, the longitudinal axis of the web 39 of the Z-shaped pawl between 34 and 37 essentially coincides with the longitudinal axis 40 (FIG. 3) of a control bar 41 mounted displaceably in a channel 41.1, (FIG. 6) in the slide part 24. It is especially advantageous to design the detent pawl 26 so that it is effective as a blocking pawl relative to the toothed engagement part 25 when the slide part 24 is loaded. This occurs when the connecting line (not shown) between the centers of rounding of the engagement cam 34 and of the socket joint 38 forms an angle of at least 45° in the position of rest of the pawl. However, this angle should exceed 45° only slightly, that is to say be approximately in the range of 45° to 48°, to prevent the braking effect from being increased excessively during the pull-out movement of the slide part 24. The design of the detent pawl 26 as a blocking pawl also ensures that, in practice, it cannot be released when the seat surface of the chair is loaded. This prevents a jerky adjustment of the chair height.

The control bar 41 is mounted so as to be longitudinally displaceable at the top of the chair column (on the left in FIGS. 2 and 3) in a bore of the guide member 22 which is a continuation of the channel 41.1, and extends beyond the guide member 22 by means of a control head 42, so that it projects to a sufficient extent beyond the distal end of the support tube 2 (FIG. 2). By means of pressure on the control knob 42, the control bar 41 can be shifted to the right, the spring-loaded detent pawl 26 pivoting about the socket joint 38 in the counter-clockwise direction and lifting the engagement cam out of the momentarily occupied tooth space 35.

In this way, relative longitudinal displacement between the two tube elements 1, 2 up to the particular end position is possible, depending on the initial position of the support tube 2 in the upright tube 1. These two positions are shown in FIGS. 4*a* and 4*b*. FIG. 4*a* shows the maximum extended position of the support tube 2 which also emerges from FIG. 2. In this position, the engagement cam 34 is located in the outermost tooth space 35 on the left, and the stop arrangement 29, shown in more detail in FIG. 5, is in the stop position. The stop arrangement 29 consists of two pairs of stop pins 43 which are aligned with one another and which are respectively anchored on both sides of the control-bar path and detent-pawl path 41.1 (FIG. 6) in the shank material of the slide part 24 (at the top) and of the toothed engagement part 25 (at the bottom). More specifically, the stop pins 43.1 on the same side as the rack are located in the toothless end zone 25.2, and the stop pins 43.2 on the same side as the slide part are located in the left-hand end of the pawl housing 27 on the slide part 24, being so far apart from one another laterally that the control bar 41 can pass unimpeded between the stop pins 43 or 43.1, 43.2.

FIG. 4*b* shows the position of the slide part 24, toothed engagement part 25 and detent pawl 26 when the upright tube and support tube 2 are in the position pushed inwards as far as possible. In this position, the engagement cam 34 is located in the outermost tooth space 35.1 on the right, which is lengthened to the right in comparison with the remaining tooth spaces 35. The reason for this lengthening is that the inner end stop between the slide part 24 or the front end 27.1 of the pawl housing 27 and the toothed engagement part 25 occurs specifically at the stop surface 30.1 of the toothed engagement part 25.

FIGS. 2 to 7 illustrate only one of many mechanical length-adjusting elements which can be installed in the vertically adjustable swivel-chair supporting column according to the invention. It goes without saying that the slide part 24 and the toothed engagement part 25 which respectively adjoin the guide member 22 and the sprung intermediate member 23, and the locking portion composed of the detent pawl 26/28, pawl housing 27 and control bar 41 can also have a different design from that shown. In particular, the form and mounting of the detent pawl 26 and the design of the engagement toothing 25.1 can easily be adapted to meet different requirements.

I claim:

1. A vertically adjustable swivel chair support post having a vertical pipe, the bottom end of which can be secured to the pedestal of a swivel chair; a support pipe telescopically movable with respect to the vertical pipe; a swivel chair seat mounted to the top end of said support pipe; a length adjusting element installed inside said support pipe and vertical pipe, and between their outer ends, the length adjusting element capable of being locked in position with a substantially stationary part supported and centered in the vertical pipe by a spring loaded connecting member and a guide busing; and a sliding part in the support pipe, wherein the improvement comprises:

A. said sliding part being received at its upper end by a guide and mount member fastened to the top end of the support pipe;

B. said support pipe having a central opening at its top end wherein said opening is bordered by a rolled-in rim shoulder and houses a stepped diameter centering projection which extends from said guide and mount member;

C. said guide and mount member being detachably connected to the support pipe by a fastening means which engages said centering projection exterior of said shoulder;

D. said vertical pipe having at its bottom end a base means with a central bore for securing a rotating end portion of said guide bushing of the spring loaded connecting member; and E. said guide bushing being detachably fastened to the vertical pipe by a connecting means which engages said end portion of the guide bushing exterior of the supporting base.

2. The support pipe of claim 1 wherein the guide and mount member comprises a sheath, having a stepped diameter, mounted on the sliding part of the length adjusting element, said sheath having a section with a large diameter which centers the length adjusting element within the support pipe, and a section with a small diameter which extends through the central opening in the shoulder at the top end of the support pipe.

3. The support pipe of claim 1 wherein the guide and mount member is an upper guide component, having a stepped diameter, with a section having a larger diameter which centers the sliding part of the length adjusting element within the support pipe and a section with a smaller diameter which extends through the central opening in the shoulder on the top end of the support pipe.

* * * * *

UNITED STATES PATENT AND TRADEMARK OFFICE

CERTIFICATE OF CORRECTION

PATENT NO. : 4,798,358

DATED : January 17, 1989

INVENTOR(S) : Egon Brauning

It is certified that error appears in the above-identified patent and that said Letters Patent is hereby corrected as shown below:

Column 2, line 66, after "which" please insert --,--.

Column 6, line 5, replace "busing" with --bushing--.

Signed and Sealed this

Tenth Day of July, 1990

*Attest:*

HARRY F. MANBECK, JR.

*Attesting Officer*

*Commissioner of Patents and Trademarks*